US011524388B2

(12) United States Patent
Uenishi

(10) Patent No.: US 11,524,388 B2
(45) Date of Patent: Dec. 13, 2022

(54) MIRROR FINISHING METHOD AND PRODUCTION METHOD OF MIRROR FINISHING TOOL

(71) Applicant: FANUC CORPORATION, Yamanashi (JP)

(72) Inventor: Daisuke Uenishi, Yamanashi-ken (JP)

(73) Assignee: FANUC CORPORATION, Yamanashi (JP)

( * ) Notice: Subject to any disclaimer, the term of this patent is extended or adjusted under 35 U.S.C. 154(b) by 510 days.

(21) Appl. No.: 16/669,818

(22) Filed: Oct. 31, 2019

(65) Prior Publication Data

US 2020/0061776 A1 Feb. 27, 2020

Related U.S. Application Data

(62) Division of application No. 15/980,062, filed on May 15, 2018, now Pat. No. 10,717,170.

(30) Foreign Application Priority Data

May 17, 2017 (JP) ..... JP2017-098086

(51) Int. Cl.

| | |
|---|---|
| ***B24D 18/00*** | (2006.01) |
| ***B24D 3/34*** | (2006.01) |
| ***B24D 5/00*** | (2006.01) |
| *B24D 3/00* | (2006.01) |
| *B24D 11/00* | (2006.01) |
| *C09K 3/14* | (2006.01) |

(52) U.S. Cl.
CPC ..... *B24D 3/346* (2013.01); *B24D 5/00* (2013.01); *B24D 18/009* (2013.01)

(58) Field of Classification Search
USPC ..... 51/293, 307, 309
See application file for complete search history.

(56) References Cited

U.S. PATENT DOCUMENTS

| | | | | |
|---|---|---|---|---|
| 6,773,211 | B2 * | 8/2004 | Zackrisson | B23C 5/28 407/53 |
| 8,460,060 | B2 * | 6/2013 | Wilson | B24B 1/00 451/63 |
| 2003/0121159 | A1 | 7/2003 | Clemens et al. | |

(Continued)

FOREIGN PATENT DOCUMENTS

| | | |
|---|---|---|
| CA | 2752380 A1 | 3/2013 |
| CN | 2894908 Y | 5/2007 |

(Continued)

OTHER PUBLICATIONS

English Abstract and Machine Translation for Chinese Publication No. 105081355 A, published Nov. 25, 2015, 14 pgs.

(Continued)

*Primary Examiner* — James E McDonough
(74) *Attorney, Agent, or Firm* — Fredrikson & Byron, P.A.

(57) ABSTRACT

A mirror finishing method for forming a mirror surface on a workpiece with a mirror finishing tool including a conically shaped cutting tool made of polycrystalline diamond or cubic boron nitride that is attached to a distal end of a shank, performs mirror polishing by abutting a conical surface of the cutting tool against a machined surface of the workpiece with the shank tilted with respect to the machined surface of the workpiece.

1 Claim, 5 Drawing Sheets

(56) References Cited

U.S. PATENT DOCUMENTS

| | | | | |
|---|---|---|---|---|
| 2003/0190868 | A1 | 10/2003 | Palmgren | |
| 2010/0120337 | A1 | 5/2010 | Kuriyama et al. | |
| 2011/0223839 | A1 | 9/2011 | Jung et al. | |
| 2013/0138241 | A1 | 5/2013 | Arakawa et al. | |
| 2014/0220865 | A1 | 8/2014 | Glaser et al. | |
| 2014/0366456 | A1* | 12/2014 | Chapman | B23K 26/364 51/307 |
| 2015/0004884 | A1 | 1/2015 | Obayashi | |

FOREIGN PATENT DOCUMENTS

| | | | |
|---|---|---|---|
| CN | 103209794 | A | 7/2013 |
| CN | 104989397 | A | 10/2015 |
| CN | 105081355 | A | 11/2015 |
| CN | 205834278 | U | 12/2016 |
| DE | 3632482 | A1 | 3/1988 |
| DE | 602005001590 | T2 | 3/2008 |
| JP | 55125904 | A | 9/1980 |
| JP | 5932310 | U | 2/1984 |
| JP | 2110570 | A | 4/1990 |
| JP | 2116457 | A | 5/1990 |
| JP | 3232973 | A | 10/1991 |
| JP | 4193404 | A | 7/1992 |
| JP | 516004 | A | 1/1993 |
| JP | 653004 | U | 7/1994 |
| JP | 8206953 | A | 8/1996 |
| JP | 8243927 | A | 9/1996 |
| JP | 2828424 | B2 | 11/1998 |
| JP | 11267925 | A | 10/1999 |
| JP | 2002326217 | A | 11/2002 |
| JP | 2003205479 | A | 7/2003 |
| JP | 2004148431 | A | 5/2004 |
| JP | 2004154932 | A | 6/2004 |
| JP | 3572039 | B2 | 9/2004 |
| JP | 2004291157 | A | 10/2004 |
| JP | 200588148 | A | 4/2005 |
| JP | 2006289566 | A | 10/2006 |
| JP | 2013111691 | A | 6/2013 |
| JP | 201533726 | A | 2/2015 |
| WO | 2013059279 | A1 | 6/2013 |
| WO | 2017027730 | A1 | 2/2017 |

OTHER PUBLICATIONS

English Abstract and Machine Translation for Chinese Publication No. 205834278 U, published Dec. 28, 2016, 11 pgs.
English Abstract and Machine Translation for Chinese Publication No. 103209794 A, published Jul. 17, 2013, 15 pgs.
English Abstract and Machine Translation for Chinese Publication No. 2894908 Y, published May 2, 2007, 9 pgs.
English Abstract and Machine Translation for Chinese Publication No. 104989397 A, published Oct. 21, 2015, 8 pgs.
English Abstract and Machine Translation for German Publication No. 602005001590 T2, published Mar. 13, 2008, 16 pgs.
English Abstract and Machine Translation for German Publication No. 3632482 A1, published Mar. 31, 1988, 8 pgs.
English Abstract for Japanese Publication No. 2003205479 A, published Jul. 22, 2003, 1 pg.
English Abstract and Machine Translation for Japanese Publication No. 08-243927 A, published Sep. 24, 1996, 8 pgs.
English Abstract and Machine Translation for Japanese Publication No. 06-053004 U, published Jul. 19, 1994, 6 pgs.
English Abstract and Machine Translation for Japanese Publication No. 2015-033726 A, published Feb. 19, 2015, 30 pgs.
English Abstract and Machine Translation for Japanese Publication No. 02-116457 A, published May 1, 1990, 5 pgs.
English Abstract and Machine Translation for Japanese Publication No. 2002-326217 A, published Nov. 12, 2002, 7 pgs.
English Abstract and Machine Translation for Japanese Publication No. 2005-088148 A, published Apr. 7, 2005, 12 pgs.
English Abstract for Japanese Publication No. 2013-111691 A, published Jun. 10, 2013, 2 pgs.
English Abstract and Machine Translation for Japanese Publication No. 08-206953 A, published Aug. 13, 1996, 15 pgs.
English Abstract and Machine Translation for Japanese Publication No. 2828424 B2, published Nov. 25, 1998, 23 pgs.
English Abstract and Machine Translation for Japanese Publication No. 11-267925 A, published Oct. 5, 1999, 25 pgs.
English Abstract and Machine Translation for Japanese Publication No. 2004-148431 A, published Sep. 29, 2004, 7 pgs.
English Abstract and Machine Translation for Japanese Publication No. 3572039 B2, published Sep. 29, 2004, 7 pgs.
English Abstract and Machine Translation for Japanese Publication No. 2004-291157 A, published Oct. 21, 2004, 6 pgs.
English Abstract and Machine Translation for Japanese Publication No. 2006-289566 A, published Oct. 26, 2006, 8 pgs.
Untranslated Decision to Grant a Patent mailed by Japan Patent Office (JPO) for Application No. 2017-099086, dated Mar. 19, 2019, 4 pgs.
English Machine Translation of Decision to Grant a Patent mailed by Japan Patent Office (JPO) for Application No. 2017-099086, dated Mar. 19, 2019, 3 pgs.
Untranslated Notification of Reasons for Refusal mailed by Japan Patent Office (JPO) for Application No. 2017-099086, dated Nov. 6, 2018, 4 pgs.
English Machine Translation of Notification of Reasons for Refusal mailed by Japan Patent Office (JPO) for Application No. 2017-099086, dated Nov. 6, 2018, 3 pgs.
English Abstract and Machine Translation for Japanese Publication No. JPS55-125904 A, published Sep. 29, 1980, 7 ogs.
English Machine Translation for Japanese Publication No. JPS59-032310 U, published Feb. 28, 1984, 5 pgs.
English Abstract and Machine Translation for Japanese Publication No. JPH05-016004 A, published Jan. 26, 1993, 11 pgs.
English Abstract and Machine Translation for Japanese Publication No. JPH02-110570 A, published Apr. 23, 1990, 11 pgs.
English Abstract and Machine Translation for Japanese Publication No. JPH03-232973 A, published Oct. 16, 1991, 6 pgs.
English Abstract and Machine Translation for Japanese Publication No. JPH04-193404 A, published Jul. 13, 1992, 6 pgs.
English Abstract and Machine Translation for Japanese Publication No. 2004-154932 A, published Jun. 3, 2004, 4 pgs.

* cited by examiner

MIRROR FINISHING METHOD AND PRODUCTION METHOD OF MIRROR FINISHING TOOL

CROSS-REFERENCE TO RELATED APPLICATIONS

This is a division of U.S. application Ser. No. 15/980,062, filed May 15, 2018, which is based upon and claims the benefit of priority from Japanese Patent Application No. 2017-098086 filed on May 17, 2017, the contents of which are incorporated herein by reference.

BACKGROUND OF THE INVENTION

Field of the Invention

The present invention relates to a mirror finishing method for mirror finishing a workpiece and a method for producing a mirror finishing tool used for mirror finishing a workpiece.

Description of the Related Art

Japanese Laid-Open Utility Model Publication No. 06-053004 discloses a tool for mirror finishing having a single crystal diamond tip attached to the distal end of a shank via an insert.

SUMMARY OF THE INVENTION

When the material of a workpiece is aluminum or the like having a relatively low hardness, it is possible for the single crystal diamond tip disclosed in Japanese Laid-Open Utility Model Publication No. 06-053004 to perform mirror finishing. However, when the workpiece is formed of a high hardness material such as stainless steel or titanium, single-crystal diamond tips cannot be used to perform mirror-finishing. Instead of single crystal diamond, materials of higher hardness such as polycrystalline sintered diamond and cubic boron nitride are used as a tip. However, due to high hardness, a lot of restrictions are imposed on the machining shape so that the width of the cutting tool cannot be increased, resulting in low productivity.

The present invention has been devised to solve the above problems, it is therefore an object of the present invention to provide a mirror finishing method capable of improving productivity in mirror finishing of a workpiece, and a producing method of a mirror finishing tool.

One aspect of the present invention resides in a mirror finishing method for forming a mirror surface on a workpiece by a mirror finishing tool, including the steps of: tilting a shank of the mirror finishing tool with respect to a machined surface of the workpiece, a conically shaped cutting tool being attached to a distal end of the shank, the cutting tool made of polycrystalline diamond or cubic boron nitride; and performing mirror polishing by abutting a conical surface of the cutting tool against the machined surface.

According to the present invention, it is possible to improve productivity in performing mirror finishing on a workpiece.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Now, the present invention will be described by reference to embodiments of the invention. The following embodiments will not limit the invention defined in the claims. Not all combinations of features described in the embodiments are necessarily essential to the solving means of the invention.

First Embodiment

[Configuration of Mirror Finishing Tool]

Figure 1:
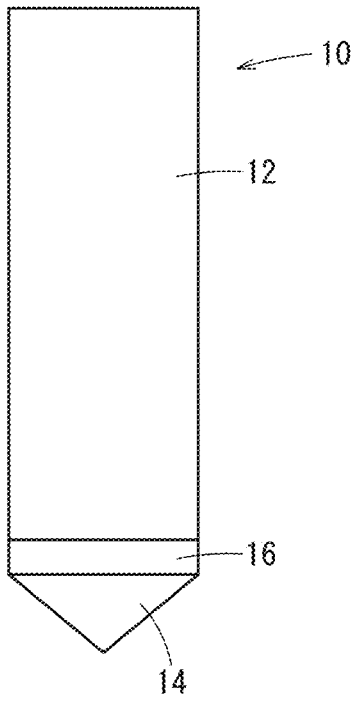
FIG. 1 is a schematic diagram showing a configuration of a mirror finishing tool.

FIG. 1 is a schematic diagram showing a configuration of a mirror finishing tool 10 of this embodiment. The mirror finishing tool 10 is attached to a spindle of a machine tool (not shown) and used for mirror finishing (or mirror polishing) the surface of a workpiece W (FIG. 3) made of stainless steel or titanium.

In the mirror finishing tool 10, a cutting tool 14 is attached to the distal end of a shank 12 clamped by an unillustrated chuck of the spindle via a brazing portion 16. The cutting tool 14 is formed in a conical shape and made of polycrystalline diamond (hereinafter referred to as PCD) or cubic boron nitride (hereinafter referred to as cBN).

[Production Method of Mirror Finishing Tool]

Figure 2:
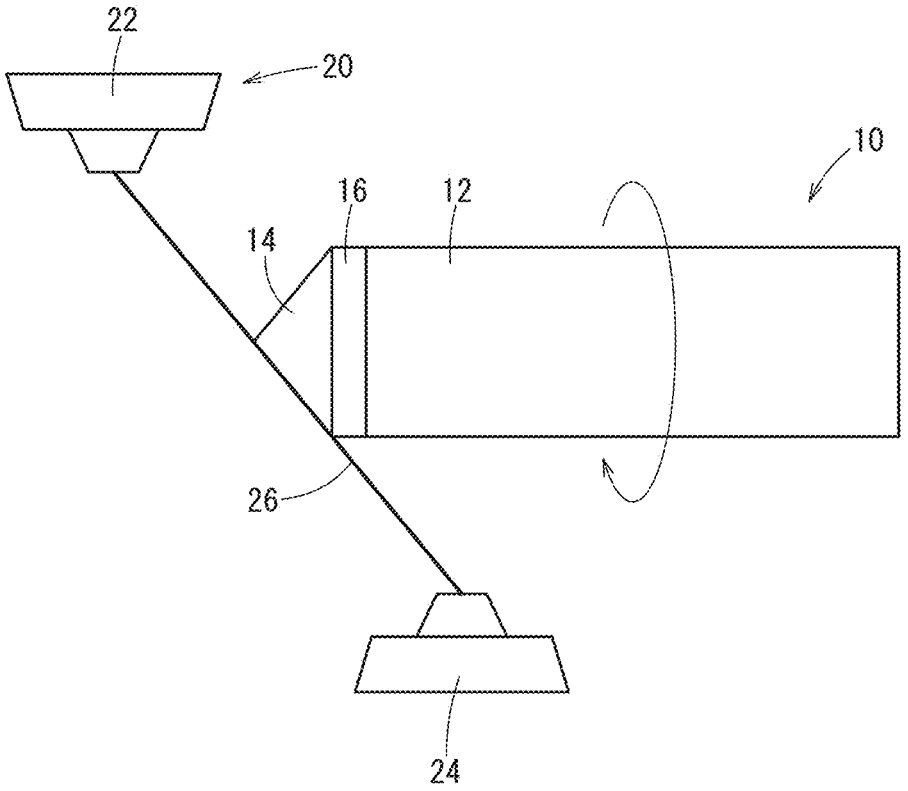
FIG. 2 is a schematic diagram showing a method of producing a mirror finishing tool.

FIG. 2 is a schematic diagram showing a method of producing the mirror finishing tool 10. After the cutting tool 14 is joined to the distal end of the shank 12 via the brazing portion 16, the cutting tool 14 of the mirror finishing tool 10 is machined into a conical shape by a wire electrical discharge machine 20. Specifically, the wire electrical discharge machine 20 machines the cutting tool 14 of the mirror finishing tool 10 into a conical shape by electrical discharge machining while axially turning the mirror finishing tool 10 with a wire electrode 26 that is stretched between upper wire and lower guides 22, 24 and tilted with respect to a straight line normal to the horizontal plane. In the process, the discharge condition between the wire electrode 26 and the cutting tool 14 is adapted to be changed multiple times during one revolution of the mirror finishing tool 10 around the axis. The discharge condition may be changed periodically or non-periodically (at irregular intervals). This process of machining the cutting tool 14 while changing the discharge condition during electrical discharge machining makes it possible to form the cutting tool 14 so as to have an irregular surface having no isotropy. Here, it should be noted that the cutting tool 14 may be subjected to electrical discharge machining in a state where the axis of the mirror finishing tool 10 is tilted with respect to the horizontal plane while the wire electrode 26 is stretched so as to be normal to the horizontal plane.

[Processing Method by Mirror Finishing Tool]

Figure 3:
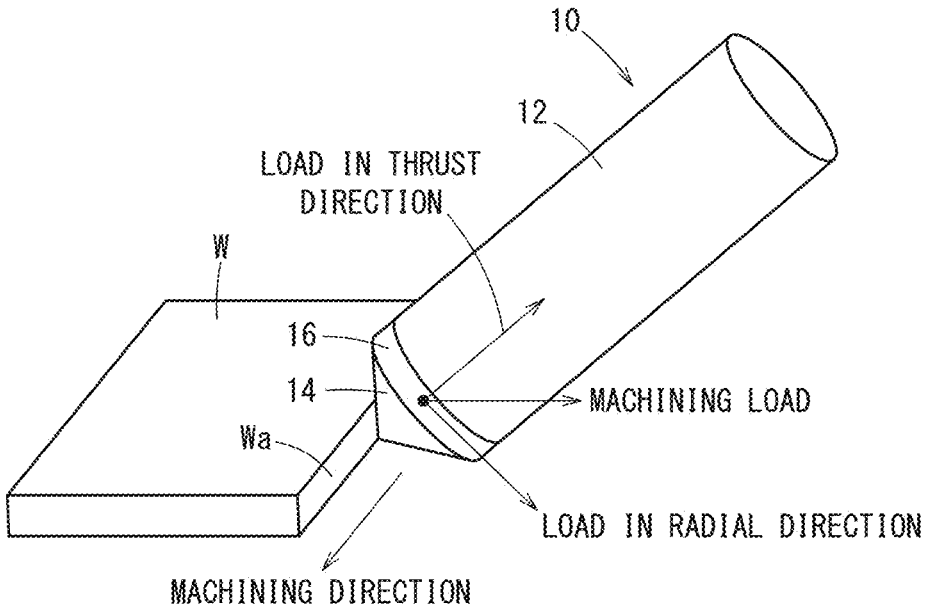
FIG. 3 is a diagram for explaining a mirror finishing method of a workpiece by a mirror finishing tool.

FIG. 3 is a view for explaining a mirror finishing method of the workpiece W by the mirror finishing tool 10. As shown in FIG. 3, in mirror polishing the workpiece W by the mirror finishing tool 10, the mirror finishing tool 10 is moved in the processing direction relative to the workpiece W with the axis of the mirror finishing tool 10 (shank 12) inclined with respect to the direction normal to the machined surface, designated at Wa, of the workpiece W so that the conical surface of the cutting tool 14 can be brought into contact with the workpiece surface Wa. As a result, the counterforce (machining load) acting on the cutting tool 14 from the workpiece W when the cutting tool 14 is pressed against the machined surface Wa is transferred to the brazing portion 16 as two decomposed components, i.e., the thrust component force (in the axial direction of the mirror finishing tool 10) and the radial component force (in the radial direction of the mirror finishing tool 10).

[Operation and Effect]

Conventionally, mirror finishing of workpieces made of aluminum and the like is performed by a mirror finishing tool using single crystal diamond (hereinafter referred to as SCD)) as a cutting tool. However, it is difficult with the cutting tool of the SCD to mirror-finish a workpiece W made of stainless steel, titanium or the like, which is higher in hardness than aluminum and the like. Therefore, currently, mirror finishing tools with cutting tools formed of PCD and cBN having higher hardness than the SCD, have appeared. The current mirror finishing tools using the PCD and cBN as their cutting tool is narrow in cutting width because the cutting tool is spherical. In order to increase the cutting width, it is necessary to widen the cutting tool. However, PCD and cBN are difficult to increase the width of the cutting tool compared with SCD for the following reasons.

The first reason is that though PCD and cBN are synthesized artificially like SCD, it is difficult to enlarge them compared to SCD. The second reason is that since PCD and cBN are harder than SCD and have no dependence of hardness on orientation unlike SCD, it is difficult to machine the cutting tool and the shape of the cutting tool that can be machined is limited.

Figure 4:
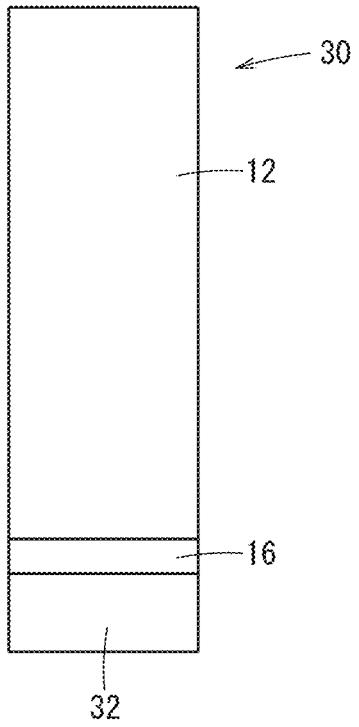
FIG. 4 is a schematic diagram showing a configuration of a mirror finishing tool of a comparative example.
Figure 5:
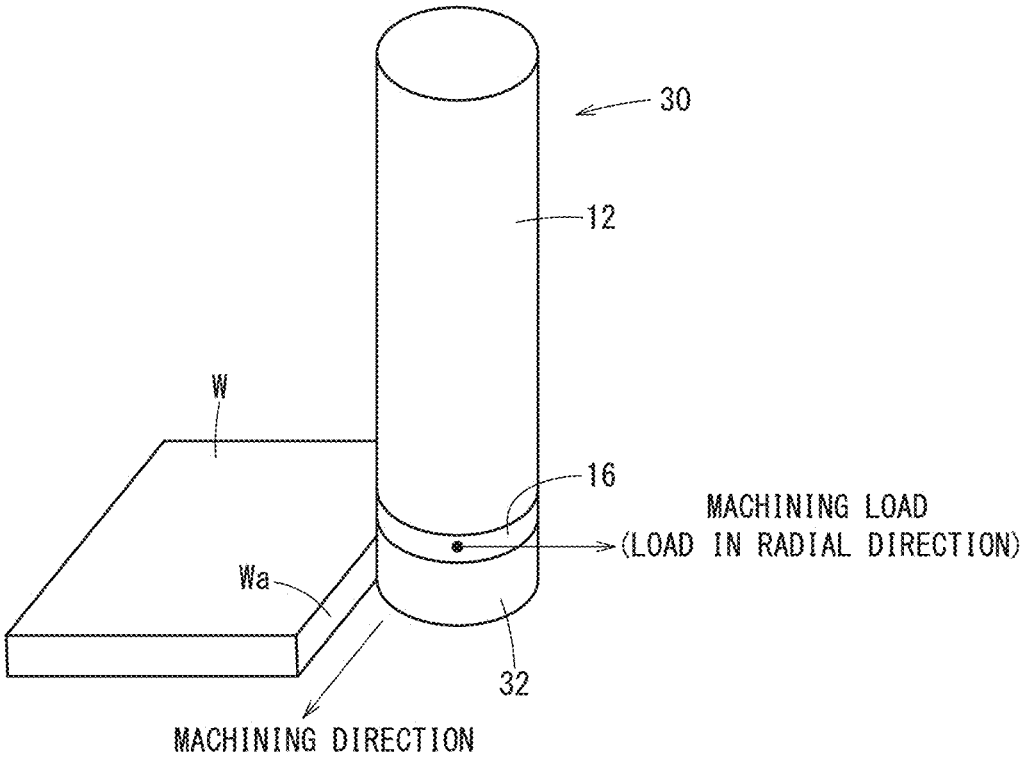
FIG. 5 is a diagram for explaining a mirror finishing method of a workpiece by a mirror finishing tool of a comparative example.

Under the limitations as above, it is conceivable to form the cutting tool into a cylindrical shape so as to widen the cutting tool made of PCD or cBN. FIG. 4 is a schematic diagram showing a configuration of a mirror finishing tool 30 of a comparative example. The mirror finishing tool 30 of the comparative example is different from the mirror finishing tool 10 of the present embodiment in that its cutting tool, designated at 32, has a cylindrical shape. FIG. 5 is a diagram for explaining a mirror finishing method of the workpiece W by the mirror finishing tool 30 of the comparative example.

In the mirror finishing tool 30, the mirror finishing tool 10 is moved in the machining direction relative to the workpiece W with the side of the cylindrical cutting tool 32 abutted against the machined surface Wa. The counterforce (machining load) on the cutting tool 32 from the workpiece W when the cutting tool 32 is pressed against the machined surface Wa acts in the radial direction (radial direction) of the cutting tool 32 so that the component force in the radial direction is also applied to the brazing portion 16. The brazing portion 16 is less strong against the force in the radial direction than against the axial (thrust) force. Therefore, the mirror finishing tool 30 of the comparative example entails the risk that the cutting tool 32 will fall off during machining of the workpiece W. Although it is possible to prevent the cutting tool 32 from coming off by keeping the bottom surface portion of the cylindrical cutting tool 32 in contact with the machined surface Wa of the workpiece W, it is impossible to machine the machined surface Wa with the bottom surface portion of the cutting tool 32 when the machined surface Wa has an arcuate inner circumferential surface.

To deal with this, in the present embodiment, the cutting tool 14 is formed in a conical shape and is used to machine the workpiece W by moving the mirror finishing tool 10 (shank 12) in the processing direction relative to the workpiece W with its axis tilted with respect to the direction normal to the machined surface Wa of the workpiece W and the conical surface of the cutting tool 14 abutted against the workpiece surface Wa. As a result, the counterforce (machining load) acting on the cutting tool 14 from the workpiece W when the cutting tool 14 abuts against the machined surface Wa, is transferred to the brazing portion 16 as the thrust component force (in the axial direction of the mirror finishing tool 10) and the radial component force (in the radius direction thereof). Accordingly, the force acting on the brazing portion 16 is dispersed into a force component in the axial direction (thrust direction) in which the brazing portion 16 presents a higher strength than in the radial direction (radial direction) so as to be able to prevent the cutting tool 14 from falling off. Further, the cutting tool 14 is formed in a conical shape, hence can be widened so as to secure a wide cutting width for the mirror finishing tool 10, which leads to improved productivity.

Further, in the present embodiment, the cutting tool 14 is formed into a conical shape by electrical discharge machining. Furthermore, when turning the mirror finishing tool 10 one revolution around the axis, the discharge condition between the wire electrode 26 and the cutting tool 14 is changed multiple times. This makes it possible to provide the cutting tool 14, which is configured to abut against the machined surface Wa of the workpiece W, with an irregular surface having no isotropy. As a result, the machined surface Wa of the workpiece W after the mirror finish by the mirror finishing tool 10 can be formed to be a surface free from polishing lines.

Other Embodiments

Although the present invention has been described with reference to the embodiments, the technical scope of the present invention should not be limited to the scope described in the above embodiments. It goes without saying that various modifications and/or improvements can be added to the above embodiments. It is obvious from the description of the scope of the claims that modes with such modifications and/or improvements can be included in the technical scope of the present invention.

[Technical Ideas Obtained from Embodiments]

Technical ideas that can be grasped from the above embodiment will be described below.

In a mirror finishing method for forming a mirror surface on the workpiece (W) by the mirror finishing tool (10), the mirror finishing tool (10) including the shank (12) and the conically shaped cutting tool (14) attached to a distal end of the shank (12), the cutting tool (14) made of polycrystalline diamond or cubic boron nitride, the method includes a step of: performing mirror polishing by abutting the conical surface of the cutting tool (14) against a machined surface (Wa) of the workpiece (W) with the shank (12) tilted with respect to the machined surface (Wa) of the workpiece (W). As a result, the counterforce (machining load) acting on the cutting tool (14) from the workpiece (W) when the cutting tool (14) is pressed against the workpiece (W) is decomposed into the axial component force (in the thrust direction of the mirror finishing tool (10)) and the radial component force (in the radial direction of the mirror finishing tool (10)), so that it is possible to prevent the cutting tool (14) from dropping off.

In a method for producing the mirror finishing tool (10) including the shank (12) and the conically shaped cutting tool (14) attached to a distal end of the shank (12), the cutting tool (14) made of polycrystalline diamond or cubic boron nitride, the method includes a step of: machining the cutting tool (14) into a conical shape while turning the cutting tool (14) relative to the wire electrode (26) by the wire electrical discharge machine (20). As a result, the surface of the cutting tool (14) abutting against the workpiece (W) can be made to be an irregular surface having no isotropy, hence the machined surface (Wa) of the workpiece (W) after the mirror finish by the mirror finishing tool (10) can be formed to be a surface free from polishing lines.

In the method for producing the mirror finishing tool (10), when the cutting tool (14) is machined into the conical shape while being turned relative to the wire electrode (26) by the wire electrical discharge machine (20), the discharge condition between the wire electrode (26) and the cutting tool (14) may be changed during one revolution of the cutting tool (14). As a result, the surface of the cutting tool (14) abutting against the workpiece (W) can be made to be an irregular surface having no isotropy, hence the machined surface (Wa) of the workpiece (W) after the mirror finish by the mirror finishing tool (10) can be formed to be a surface free from polishing lines.

What is claimed is:

1. A method for producing a mirror finishing tool, comprising the steps of:

tilting a cutting tool attached to a distal end of a shank of the mirror finishing tool, with respect to a direction in which a wire electrode of a wire electrical discharge machine extends, the cutting tool made of polycrystalline diamond or cubic boron nitride; and machining the cutting tool into a conical shape by the wire electrical discharge machine while axially turning the cutting tool, wherein in the step of machining the cutting tool, a discharge condition between the wire electrode and the cutting tool is changed during one revolution of the cutting tool to create an irregular surface having no isotropy.

* * * * *